US011352937B1

(12) United States Patent
Dreyer et al.

(10) Patent No.: US 11,352,937 B1
(45) Date of Patent: Jun. 7, 2022

(54) MARINE DRIVES AND COOLING SYSTEMS FOR MARINE DRIVES HAVING A CRANKCASE COOLER

(71) Applicant: Brunswick Corporation, Mettawa, IL (US)

(72) Inventors: Robert Dreyer, Appleton, WI (US); Chetan Avinash Dharmadhikari, North Fond Du Lac, WI (US); Nathan C. King, Fond du Lac, WI (US); Barry P. Schleicher, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/169,952

(22) Filed: Feb. 8, 2021

(51) Int. Cl.
*F01P 3/20* (2006.01)
*B63H 21/38* (2006.01)
(Continued)

(52) U.S. Cl.
CPC ..... *F01P 3/20* (2013.01); *B63H 21/383* (2013.01); *F01P 5/10* (2013.01); *F01P 7/14* (2013.01); *F01P 11/0276* (2013.01); *F28F 17/005* (2013.01); *F28F 27/02* (2013.01); *F01P 2007/146* (2013.01); *F01P 2060/04* (2013.01); *F28F 2250/06* (2013.01)

(58) Field of Classification Search
CPC .. F02B 61/045; F02B 75/007; F02B 29/0462; F01P 3/202; F01P 2003/027; F01P 7/165; F01P 2050/12; F01P 2003/021; F01P 2003/024; F01P 2007/146; F01P 2060/04; F01P 3/02; B63H 20/28; B63H 21/383
See application file for complete search history.

(56) References Cited

U.S. PATENT DOCUMENTS 2,656,825 A 10/1953 Hartz
3,918,418 A 11/1975 Horn
(Continued)

OTHER PUBLICATIONS

Hoffman et al., unpublished U.S. Appl. No. 16/128,719, filed Sep. 12, 2018.

*Primary Examiner* — George C Jin
*Assistant Examiner* — Teuta B Holbrook
(74) *Attorney, Agent, or Firm* — Andrus Intellectual Property Law, LLP

(57) ABSTRACT

A marine drive is for propelling a vessel in body of water. The marine drive has a powerhead, a crankcase on the powerhead, and a cooling system that pumps a first flow of cooling water from the body of water through a powerhead cooling conduit for cooling the powerhead and in parallel pumps a second flow of cooling water from the body of water through a crankcase cooler for cooling the crankcase and lubricant in the crankcase. A valve controls the second flow of the cooling water to the crankcase cooler. The valve is normally positioned in a closed position, which inhibits the second flow of cooling water to the crankcase cooler and thereby reduces condensation of water from the lubricant in the crankcase. The valve is moved into an open position upon operation of the powerhead at or above a threshold speed, which permits the second flow of cooling water to the crankcase cooler and thereby cools the lubricant in the crankcase. Corresponding methods of operating the marine drive and cooling system are provided.

20 Claims, 6 Drawing Sheets

(51) Int. Cl.

| | |
|---|---|
| ***F01P 5/10*** | (2006.01) |
| ***F01P 7/14*** | (2006.01) |
| ***F28F 27/02*** | (2006.01) |
| ***F28F 17/00*** | (2006.01) |
| ***F01P 11/02*** | (2006.01) |

(56) References Cited

U.S. PATENT DOCUMENTS

| | | | | |
|---|---|---|---|---|
| 4,698,761 | A * | 10/1987 | Cooper | G05D 23/24 701/19 |
| 5,109,809 | A | 5/1992 | Fujimoto | |
| 5,876,256 | A | 3/1999 | Takahashi et al. | |
| 5,937,801 | A | 8/1999 | Davis | |
| 6,012,956 | A | 1/2000 | Mishima et al. | |
| 6,059,619 | A | 5/2000 | Nozue | |
| 6,540,573 | B2 | 4/2003 | Sato | |
| 6,733,352 | B1 | 5/2004 | Belter et al. | |
| 7,806,740 | B1 | 10/2010 | Taylor et al. | |
| 8,696,394 | B1 | 4/2014 | Langenfeld et al. | |
| 9,365,274 | B1 | 6/2016 | George et al. | |
| 9,403,588 | B1 | 8/2016 | George et al. | |
| 9,457,881 | B1 | 10/2016 | Belter et al. | |
| 9,616,987 | B1 | 4/2017 | Langenfeld et al. | |
| 10,047,661 | B1 | 8/2018 | Torgerud | |
| 10,233,818 | B1 | 3/2019 | Reichardt et al. | |
| 10,239,598 | B2 | 3/2019 | Jaszewski | |
| 10,318,423 | B2 | 6/2019 | Liu | |
| 10,344,639 | B1 | 7/2019 | Nickols et al. | |
| 10,800,502 | B1 | 10/2020 | Alby et al. | |
| 10,858,974 | B1 | 12/2020 | Hoffman et al. | |
| 10,890,097 | B1 * | 1/2021 | Kurzynski | F01P 3/02 |
| 11,073,116 | B1 * | 7/2021 | Dins | F01P 9/02 |
| 2001/0039156 | A1 | 11/2001 | Sato | |
| 2002/0088425 | A1 | 7/2002 | Westerbeke | |
| 2005/0042949 | A1 * | 2/2005 | Tawa | F01P 7/165 440/88 C |
| 2013/0092116 | A1 * | 4/2013 | Teshima | F02F 3/04 123/193.4 |
| 2013/0273792 | A1 | 10/2013 | Davis et al. | |
| 2017/0328265 | A1 | 11/2017 | George et al. | |
| 2018/0251202 | A1 | 9/2018 | Saruwatari et al. | |

* cited by examiner

MARINE DRIVES AND COOLING SYSTEMS FOR MARINE DRIVES HAVING A CRANKCASE COOLER

FIELD

The present disclosure relates to marine drives having cooling systems with crankcase coolers and methods of cooling said marine drives.

BACKGROUND

The following U.S. Patents are incorporated herein by reference:

U.S. Pat. No. 10,858,974 discloses a marine engine having a cylinder block comprising first and second banks of cylinders disposed along a longitudinal axis and extending transversely with respect to each other in a V-shape so as to define a valley there between; and a lubricant cooler located in the valley and extending parallel to the longitudinal axis. The lubricant cooler has a lubricant conduit that conveys engine lubricant parallel to the longitudinal axis and then transversely to the longitudinal axis to the cylinder block. The lubricant cooler further has a cooling conduit that conveys cooling fluid alongside the lubricant conduit to thereby cool the lubricant conduit and the engine lubricant therein.

U.S. Pat. No. 10,800,502 discloses an outboard motor having a powerhead that causes rotation of a driveshaft, a steering housing located below the powerhead, wherein the driveshaft extends from the powerhead into the steering housing; and a lower gearcase located below the steering housing and supporting a propeller shaft that is coupled to the driveshaft so that rotation of the driveshaft causes rotation of the propeller shaft. The lower gearcase is steerable about a steering axis with respect to the steering housing and powerhead.

U.S. Pat. No. 10,344,639 discloses a marine engine having a crankcase with a crankshaft that rotates about a vertical crankshaft axis; a cover on the crankcase; and a cooling member disposed in the crankcase. The cooling member has an inner surface that faces the crankshaft and an outer surface that faces the cover. The cooling member is configured such that rotation of the crankshaft causes lubricant in the crankcase to impinge on and drain down both the inner and outer surfaces of the cooling member.

U.S. Pat. No. 10,239,598 discloses an outboard motor having an internal combustion engine that causes rotation of a driveshaft, a planetary transmission that operatively connects the driveshaft to a transmission output shaft, a band brake configured to shift the planetary transmission amongst a forward gear, neutral gear and reverse gear, a hydraulic actuator configured to actuate the band brake, and a cooling water circuit that extends adjacent to the hydraulic actuator so that the hydraulic actuator exchanges heat with cooling water in the cooling water circuit.

U.S. Pat. No. 10,233,818 discloses a marine propulsion device having an internal combustion engine; an axially elongated exhaust conduit that conveys exhaust gas from the upstream internal combustion engine to a downstream outlet; a cooling water sprayer that is configured to spray a flow of cooling water radially outwardly toward an inner diameter of the axially elongated exhaust conduit; a temperature sensor located downstream of the cooling water sprayer and configured to sense temperature of the exhaust gas and cooling water; and a controller configured to identify a fault condition associated with the cooling water sprayer based on the temperature of the exhaust gas and cooling water.

U.S. Pat. No. 10,047,661 discloses a fuel module apparatus for a marine engine. The fuel module apparatus includes a housing having a fuel cavity and a fuel pump in the housing. The fuel pump is configured to pump fuel through the fuel cavity from an inlet on the housing to an outlet on the housing. A cooling fluid sprayer sprays cooling fluid onto an outer surface of the housing to thereby cool the housing and the fuel in the fuel cavity.

U.S. Pat. No. 9,616,987 discloses an outboard motor and a method of making an outboard motor, which provide an exhaust conduit having a first end that receives exhaust gas from an internal combustion engine and a second end that discharges exhaust gas to seawater via a propeller shaft housing outlet. An exhaust conduit opening is formed in the exhaust conduit between the first and second ends. The exhaust conduit opening is for discharging exhaust gas from the exhaust conduit to atmosphere via a driveshaft housing of the outboard motor and via an idle exhaust relief outlet and a driveshaft housing outlet in the driveshaft housing. The driveshaft housing outlet is located between the propeller shaft housing outlet and the idle exhaust relief outlet. A cooling pump pumps cooling water from a cooling water inlet for cooling the internal combustion engine to a cooling water outlet for discharging cooling water from the outboard motor. The exhaust conduit opening and cooling water outlet are configured such that the cooling water collects by gravity in the driveshaft housing to a level that is above the exhaust conduit opening.

U.S. Pat. No. 9,457,881 discloses an outboard marine engine having an engine block; a crankcase on the engine block; a crankshaft disposed in the crankcase for rotation about a crankshaft axis; a cover on the crankcase; a bedplate disposed between the engine block and the cover. The bedplate has a plurality of bearings for supporting rotation of the crankshaft. A cooling water jacket extends parallel to the crankshaft axis along a radially outer portion of the plurality of bearings. The cooling water jacket carries cooling water for cooling the plurality of bearings and at least one lubricant drain-back area is located adjacent to the cooling water jacket. The lubricant drain-back area drains lubricant from the crankcase.

U.S. Pat. No. 9,403,588 discloses systems for cooling a marine engine that is operated in a body of water. The systems can include an open loop cooling circuit for cooling the marine engine, wherein the open loop cooling circuit is configured to convey cooling water from the body of water to the marine engine so that heat is exchanged between the cooling water and the marine engine, and a pump that is configured to pump the cooling water from upstream to downstream through the open loop cooling circuit. A heat exchanger is configured to cause an exchange of heat between the cooling water located upstream of the marine engine and the cooling water located downstream of the marine engine to thereby warm the cooling water located upstream of the marine engine, prior to cooling the marine engine.

U.S. Pat. No. 9,365,274 discloses an outboard marine propulsion device having an internal combustion engine having a cylinder head and a cylinder block and an exhaust manifold that discharges exhaust gases from the engine towards a vertically elongated exhaust tube. The exhaust manifold has a plurality of inlet runners that receive the exhaust gases from the engine, and a vertically extending collecting conduit that conveys the exhaust gases from the plurality of inlet runners upwardly to a bend that redirects the exhaust gases downwardly towards the exhaust tube. A cooling water conduit is on the exhaust manifold and conveys cooling water alongside the exhaust manifold. A catalyst housing is coupled to the exhaust manifold and a cooling water jacket is on the catalyst housing and carries cooling water alongside the catalyst housing. A catalyst is disposed in the catalyst housing.

U.S. Patent Publication No. 2017/0328265 discloses an open loop cooling water system for a marine engine. A cooling water inlet receives cooling water from a body of water. A cooling water outlet discharges the cooling water back to the body of water. A cooling water circuit conveys cooling water from the cooling water inlet, through the marine engine, and to the cooling water outlet. A cooling water pump pumps cooling water from upstream to downstream through the cooling water circuit. A recirculation pump is in the cooling water circuit downstream of at least one component of the marine engine and upstream of the cooling water outlet. The recirculation pump is configured to pump cooling water from downstream of the marine engine back into the cooling water circuit upstream of the marine engine. Methods are for cooling a marine engine using an open loop cooling system.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

A marine drive is for propelling a vessel in body of water. The marine drive has a powerhead, a crankcase on the powerhead, and a cooling system that pumps a first flow of cooling water from the body of water through a powerhead cooling conduit for cooling the powerhead and in parallel pumps a second flow of cooling water from the body of water through a crankcase cooler for cooling the crankcase and lubricant in the crankcase. A valve controls the second flow of the cooling water to the crankcase cooler. The valve is normally positioned in a closed position which inhibits the second flow of cooling water to the crankcase cooler and thereby reduces condensation of water from the lubricant in the crankcase. The valve is moved into an open position upon operation of the powerhead at or above a threshold speed, which permits the second flow of cooling water to the crankcase cooler and thereby cools the lubricant in the crankcase.

In certain non-limiting examples, the valve comprises a poppet that is retained in the closed position by a spring force, and operation of the powerhead at or above the threshold speed causes the second flow of cooling water to have a pressure that overcomes the spring force and opens the poppet. A bypass conduit connects the powerhead cooling conduit to the crankcase cooler to supply the first flow of cooling water to the crankcase cooler from the powerhead.

Exemplary methods of cooling the marine drive are also provided and include pumping the first flow of cooling water from the body of water through the powerhead cooling conduit for cooling the powerhead and, in parallel, pumping the second flow of cooling water through the crankcase cooler for cooling the crankcase and lubricant in the crankcase, and further include permitting the second flow of cooling water to the crankcase cooler only when the powerhead is operated at or above the threshold speed to thereby reduce condensation from lubricant when the powerhead is operated below the threshold speed. The method can further include discharging the first flow of cooling water from the powerhead cooling conduit to the crankcase cooler Various other features, objects, and advantages of the invention will be made apparent from the following description taken together with the drawings.

BRIEF DESCRIPTION OF THE DRAWINGS

The present disclosure includes the following Figures.

DETAILED DESCRIPTION

During research and experimentation in the field of marine technologies, the present inventors have determined that prior art cooling systems for marine drives often fail to accomplish optimal temperature control of the crankcase and the lubricant contained in the crankcase, especially during operation of the marine drive in cold water conditions. Crankcase coolers are typically designed to lower crankcase temperatures at high-power demand conditions by supplying the crankcase cooler with cold water from the system's cooling water pump. However, during idle and cold-water conditions, the crankcase may never reach a high-enough temperature to avoid condensation of the lubricant contained therein. When power demand is low and water temperature is cold, prior art crankcase coolers can often overcool the crankcase—which can lead to condensation of water from the lubricant, milky lubricant, rusty cams, and/or other problems. Excessive water in the lubricant can lead to problems in engine operation. Additionally, the present inventors have found that prior art lubricant sump coolers often encounter similar problems. For example, at cold conditions, spraying cold cooling water on a lubricant sump can lead to excessive cooling and condensation in the lubricant contained therein.

The present disclosure arose during the present inventors' efforts to overcome the above-described issues, which they identified with the prior art.

Figure 1:
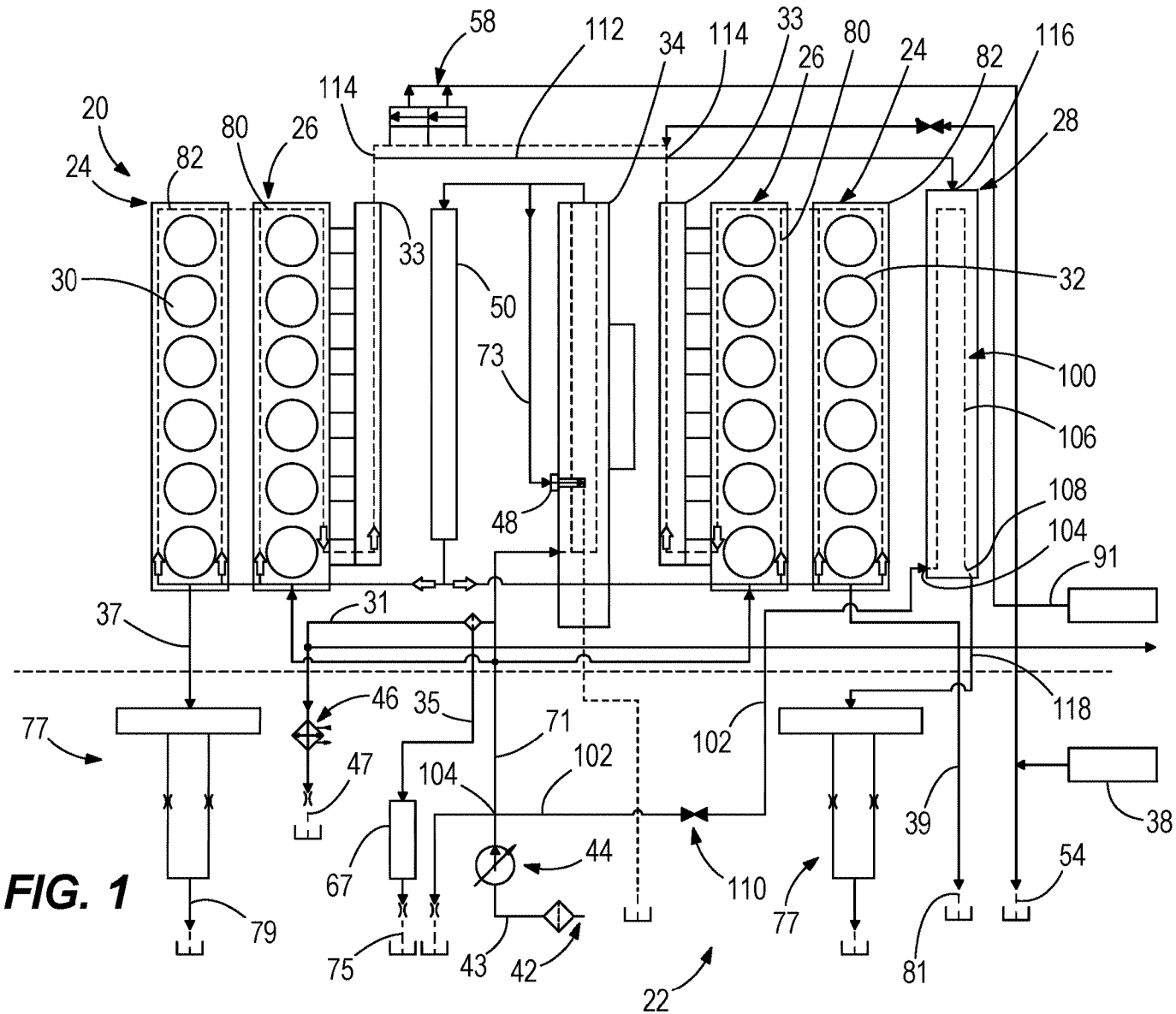
FIG. 1 is a schematic view of a marine drive and a cooling system for cooling the marine drive, according to the present disclosure.

FIG. 1 schematically depicts a powerhead, including an engine 20 configured for use in a marine drive. The engine 20 includes among other things an engine block 24 and engine heads 26 on the engine block 24. A crankcase 28 contains a crankshaft (not shown). Note that an exemplary crankcase will be further described herein below with reference to FIGS. 2-6. For the purposes of the present disclosure and claims, the term "powerhead" includes features of the engine 20 such as the engine block 24 and engine heads 26, however the term "powerhead" does not include the crankcase 28. The crankcase is treated separately from the powerhead. The engine 20 shown in the drawings is configured for use in an outboard motor, such as disclosed in U.S. Pat. No. 9,616,987. However, the concepts of the present disclosure are not limited for use with outboard motors and can be used in other marine drive configurations such as stern drives, inboard drives, marine generators, and/or the like. In the illustrated example, the engine block 24 shown in the drawings has first and second banks of cylinders 30, 32 disposed along a common crankshaft axis and extending transversely relative to each other in a V-shape to define a valley there between. However, the concepts of the present disclosure are not limited for use with V-shaped engine configurations and can for example be used in other engine configurations such as inline configurations.

Combustion of fuel in the engine 20 causes rotation of the noted crankshaft, which in turn causes rotation of a corresponding driveshaft, one or more propeller shafts, and one or more propellers configured to propel a vessel in water, all as is conventional. U.S. Pat. No. 9,616,987 discloses examples of conventional outboard motors in more detail. An exhaust conduit 34 conveys exhaust gas from the engine 20, and for discharge to the body of water in which the marine drive is operated. The exhaust conduit 34 is disposed in the noted valley and receives the exhaust gas from exhaust manifolds 33 on the engine heads 26. The exhaust conduit 34 discharges the exhaust gas directly or indirectly to an underwater exhaust gas outlet (not shown), which is typically formed through a lower gearcase of the marine drive. Optionally the exhaust conduit 34 also discharges exhaust gases directly or indirectly to atmosphere during operation at low speeds, for example via an idle relief muffler 38 and an above-water idle relief exhaust gas outlet (not shown).

According to the present disclosure, a novel cooling system 22 is provided for cooling various components of the marine drive, including but not limited to the engine block 24, engine heads 26, and crankcase 28. The cooling system 22 is an open loop system having series of conduits for conveying cooling water through the marine drive. The term "conduit" includes all means for conveyance of cooling water, including but not limited to passages, jackets, hoses or lines, and/or the like, all being for conveying the cooling water from the body of water through the marine drive, and then back to the body of water.

The cooling system 22 has an inlet 42 located on the noted lower gearcase or on any other component that is normally located underwater during operation. A conventional cooling water pump device 44 is configured to draw water into the cooling system 22 via the inlet 42 and an inlet conduit 43, for example through a screen and/or other conventional filter device. The pump device 44 can consist of one pump or more than one pump that operate together or separately. In the illustrated example, the pump device 44 is mechanically-powered by operation of the engine 20 and rotation of the noted crankshaft and driveshaft, via for example mechanical connection to the noted driveshaft, for example comprising one or more gears and/or belts, and or chains and/or the like. An example of a suitable mechanically-powered cooling water pump device is disclosed in U.S. Pat. No. 10,800,502. Accordingly, increasing the speed of the engine 20 increases the speed of the pump device 44 and thereby increases the pressure of the cooling water in the cooling system 22. Conversely, decreasing the speed of the engine 20 decreases the speed of the pump device 44 and thereby decreases the pressure of the cooling water in the cooling system 22. However, the concepts of the present disclosure are not limited for use with mechanically-powered pump devices and instead could be used with electrically-powered pump devices, and/or a hybrid of mechanically-powered and electrically-powered pump devices, and/or any other type of suitable pump device for pumping cooling water through the cooling system 22.

The pump device 44 pumps the cooling water from the inlet conduit 43 through a primary cooling conduit 71, and then through a conduit (e.g. jacket) on the exhaust conduit 34. A portion of the cooling water from the conduit on the exhaust conduit 34 is conveyed via a branch conduit 73 to one or more sprayers 48 which spray the cooling water into the exhaust gas as it is conveyed through the exhaust conduit 34, for example as disclosed in U.S. Pat. No. 10,233,818. The sprayed cooling water is discharged from the marine drive along with the exhaust gas discharged via the noted lower gearcase.

A majority of the cooling water from the cooling conduit (e.g., jacket) on the exhaust conduit 34 is conveyed through a lubricant cooler 50 in the noted valley of the engine 20, which in particular is located between the exhaust conduit 34 and the engine block 24, for example as disclosed in U.S. Pat. No. 10,858,974. From the lubricant cooler 50, the cooling water is conveyed to powerhead cooling conduits 80, 82 (e.g., passages) formed in the engine heads 26 and engine block 24, for example as is disclosed U.S. Pat. No. 9,365,274. From the powerhead cooling conduits 80, 82, the cooling water is conveyed upwardly through conduits (e.g., jackets) on the exhaust manifolds 33.

A branch conduit 37 on the powerhead cooling conduit 82 in the starboard engine block 24 drains a portion of the cooling water to a lubricant sump cooler 77 for cooling engine lubricant contained within a lubricant sump. An example of such an arrangement is disclosed in co-pending U.S. patent application Ser. No. 16/938,464, which is incorporated herein by reference in entirety. The spent cooling water from the lubricant sump cooler 77 is discharged from the marine drive via an outlet 79. A branch conduit 39 on the powerhead cooling conduit 82 in the port engine block 24 drains another portion of the cooling water via an outlet 81.

Valves 58 are mounted on the powerhead, for example as disclosed in U.S. Pat. No. 10,318,423, and are configured to control discharge of the cooling water from the powerhead cooling conduits 80, 82 based on the temperature of the cooling water in the powerhead and/or the temperature of the engine 20. In a non-limiting example, the valves 58 are conventional thermostat valves configured to automatically open and close at respective temperatures, which can be different. A suitable thermostat valve is available for commercial purchase from Mercury Marine of Fond du Lac, Wisconsin, part number 892864T04. The spent cooling water is discharged via the valves 58 to an underwater outlet 54, located for example on the noted lower gearcase, which also drains water from the idle relief muffler 38. An inlet port 91 is provided for flushing various conduits and conduits of the cooling system 22 during servicing.

In the illustrated example, a portion of the cooling water in the primary cooling conduit 71 is conveyed via a branch conduit 31 to a transmission cooler 46, which is configured for cooling a transmission associated with the marine drive, such as for example disclosed in U.S. Pat. No. 10,239,598. Spent cooling water is drained from transmission cooler 46 via an outlet 47. Another portion of the cooling water upstream of the engine 20 is conveyed via a branch conduit 35 to a fuel system cooler 67 for cooling fuel, such as for example disclosed in U.S. Pat. No. 10,047,661. Spent cooling water is drained from the fuel system cooler 67 via an outlet 75.

Thus, as described herein above and shown in FIG. 1, the cooling system 22 and associated pump device 44 are configured to pump a primary (i.e., first) flow of cooling water from the body of water through the marine drive, a majority of which is conducted through the powerhead cooling conduits 80, 82 for cooling the engine block 24 and engine heads 26. Discharge of the primary flow of cooling water is controlled by the temperature of the cooling water and powerhead, via valves 58.

According to the present disclosure, the cooling system 22 is also uniquely configured to pump a secondary (i.e., second) flow of cooling water, in parallel to the primary flow of cooling water, in particular through a crankcase cooler 100 for cooling the crankcase 28 and the lubricant in the crankcase 28 during certain operational states of the marine drive, as will be further explained herein below. The primary and secondary flows of cooling water can are pumped by the pumping device 44, which as stated herein above can include a single pump or more than one pump that operated together or separately. In the illustrated example, the pumping device 44 pumps cooling water to the crankcase cooler 100 via a bypass conduit 102 connected to and extending from a junction 105 with the primary cooling conduit 71. The bypass conduit 102 is connected to a first inlet 104 on the crankcase cooler 100. As further described herein below, the crankcase cooler 100 has a cooler conduit 106 that conveys the cooling water in one direction (e.g., upwardly) along the length of the crankcase 28 and then back in the opposite direction along the length of the crankcase 28 to an outlet 108.

A valve 110 is disposed in the bypass conduit 102 and configured to control the second flow of the cooling water to the crankcase cooler 100. The valve 110 is normally positioned in a closed position which inhibits the second flow of cooling water to the crankcase cooler 100. The valve 110 is configured to automatically move into an open position upon operation of the powerhead at or above a threshold speed, which in a non-limiting example is 3000 RPM. In a non-limiting example, the valve 110 is a poppet which is retained in the closed position by a spring applying a spring force on the poppet. The spring is configured to apply an amount of spring force that retains the valve 110 in the closed position at low engine speeds. Operation of the engine 20 at or above a threshold speed causes the speed of the pump device 44 to be such that the pressure of the first flow of cooling water in the bypass conduit 102 overcomes the spring force and causes the valve 110 to automatically open. Once the speed of the engine 20 is reduced again, the pressure of the second flow of cooling water is reduced below the spring force, which causes the valve 110 to automatically close, thus inhibiting flow of cooling water to the crankcase cooler 100. A suitable poppet is for example available for purchase from Mercury Marine, part number 8M0173055. Other types of valves could instead be employed. In other non-limiting examples, the valve 110 is an electronically-controlled valve, for example controlled by an engine control unit associated with the marine drive.

According to the present disclosure, a bypass conduit 112 connects the powerhead cooling conduits 80, 82 to the crankcase cooler 100 to supply a portion of the first flow of cooling water from the powerhead to the crankcase cooler 100 during certain operational states of the marine drive, as will be further explained herein below. In the non-limiting illustrated embodiment, the bypass conduit 112 extends from junctions 114 located upstream of the valves 58 to a second inlet 116 to the crankcase cooler 100, located between the first inlet 104 and the outlet 108. As such, the bypass conduit 112 discharges a portion of the second flow of cooling water to the crankcase cooler 100 via the second inlet 116. In other examples, the bypass conduit 112 could extend from other locations in the cooling system 22. Optionally for example, the bypass conduit 112 could include one or more valves, such as poppet valves for controlling flow therethrough. The locations of the various inlets and outlet on the crankcase cooler 100 can also vary from what is shown. The crankcase cooler 100 then discharges the first and second flows of cooling water via the outlet 108.

In use, the cooling system 22 will convey the noted first and second flows of cooling water differently based upon the speed of operation of the engine 20 and based upon pressures within the cooling system 22. When the engine 20 is operated below the noted threshold speed, the valve 110 will normally remain closed due to the noted spring force being higher than the outlet pressure of the pump device 44, thus permitting little or no flow of cooling water to the crankcase cooler 100 via the bypass conduit 102. The first flow of cooling water, which has been warmed as it is conveyed through the powerhead, is supplied to the cooler conduit 106 in the crankcase cooler 100 and then drained via the outlet 108. The warmed cooling water thus warms the crankcase 28, avoiding condensation of water from the lubricant in the crankcase 28. Alternately, when the engine 20 is operated above the noted threshold speed, the valve 110 is automatically opened due to the outlet pressure of the pump device 44 being higher than the noted spring force, which permits the second flow of cooling water to the crankcase cooler 100 via the bypass conduit 102. When this occurs, the first flow of cooling water may or may not continue to flow from the powerhead to the crankcase cooler 100. The amount and direction of flow of the first flow of cooling water in the bypass conduit 112 will vary based on pressures in the cooling system 22.

As such, the cooling system 22 advantageously automatically limits flow of cold cooling water to the crankcase cooler 100 during operation at low engine speeds, which reduces condensation of water from the lubricant in the crankcase 28 when the marine drive is operated in cold water conditions at idle or low speeds. The cooling system 22 also advantageously permits the second flow of the relatively warm first flow of cooling water to the crankcase cooler 100, which further reduces condensation of water. During operation at high engine speeds (i.e., above the noted threshold speed), the cooling system 22 advantageously cools the lubricant in the crankcase 28 by automatically supplying the relatively cold second flow of cooling water to the crankcase cooler 100. This is advantageous because when the marine drive is operated at higher speeds, higher temperatures in the crankcase 28 and associated lubricant typically result.

As shown in FIG. 1, a discharge conduit 118 gravity drains the cooling water from the outlet 108 to the lubricant sump cooler 77 for cooling engine lubricant. In a non-limiting example, the lubricant sump cooler 77 comprises a shower that showers cooling water onto surfaces of the sump, as disclosed in co-pending U.S. patent application Ser. No. 16/938,464. Thus, it will be understood that the temperature of the cooling water supplied to the lubricant sump cooler 77 will be primarily controlled based upon the speed of the engine 20 and the open/closed stated of the valve 58, as explained above. This advantageously provides the benefits described herein above, wherein condensation of water from the lubricant in the lubricant sump cooler 77 is avoided by avoiding overcooling.

Figure 2:
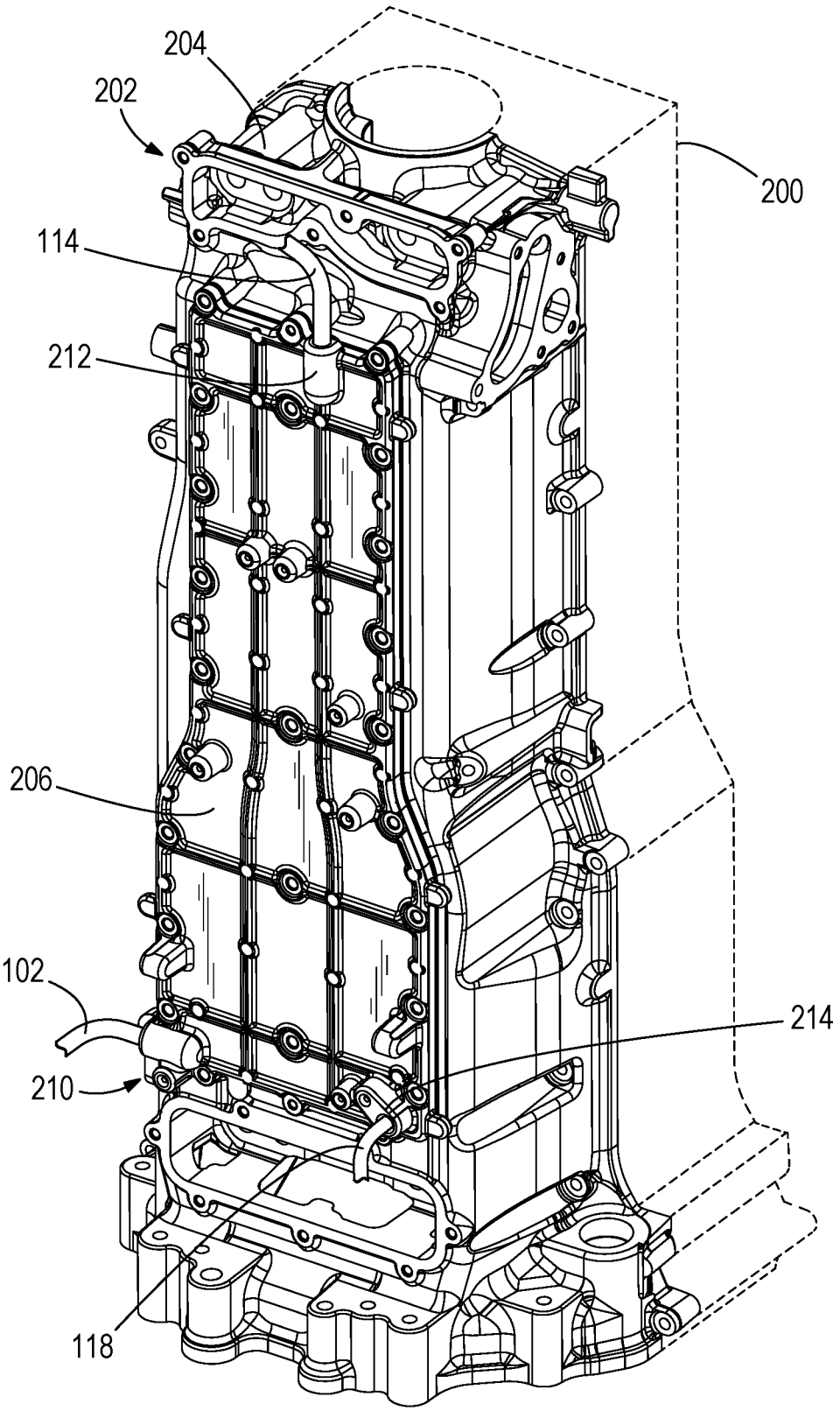
FIG. 2 is a perspective view of a portion of the marine drive, including a crankcase in dashed lines, a crankcase cover in solid lines, and a crankcase cooler cover on the crankcase cover in solid lines.
Figure 3:
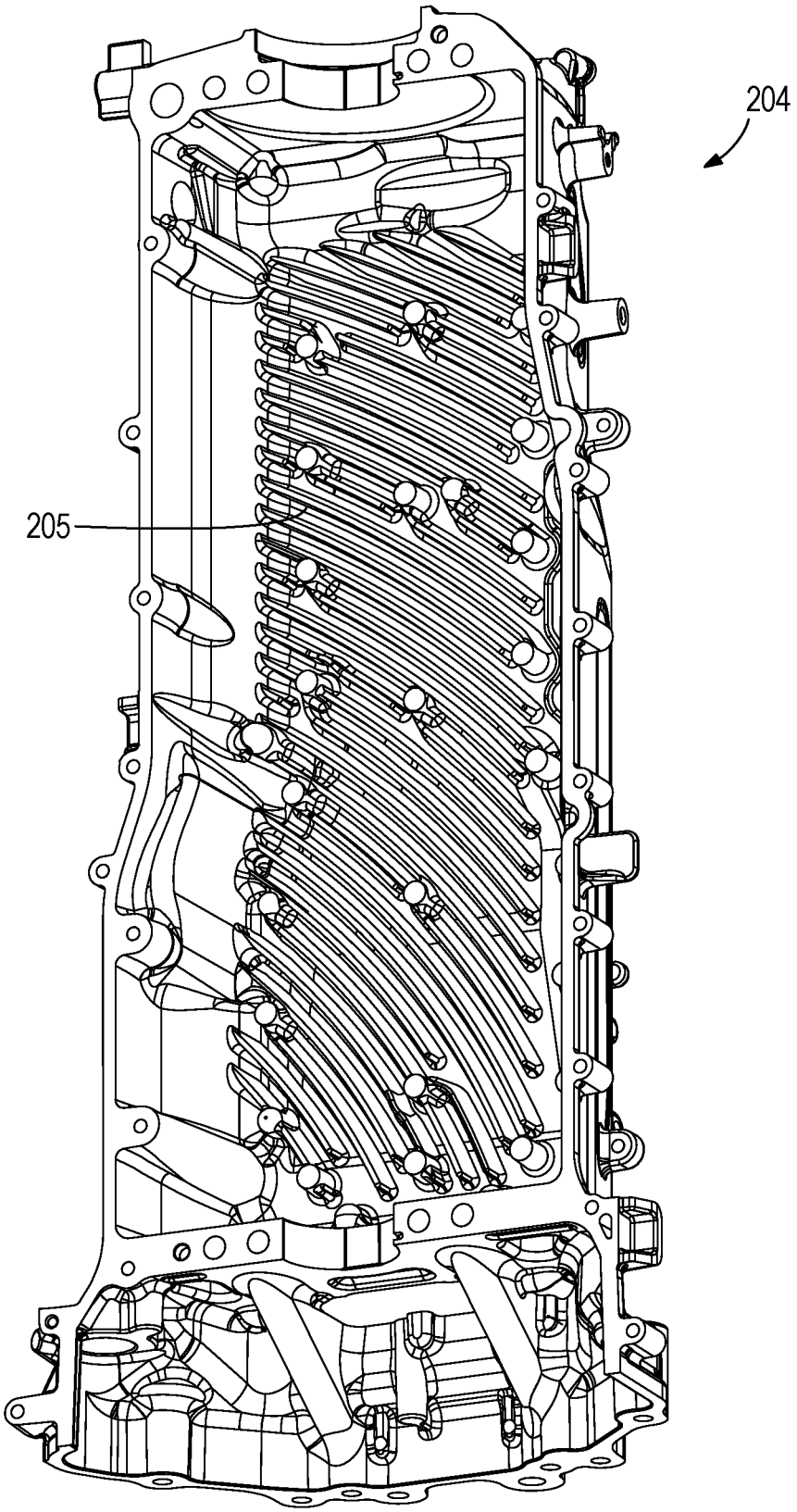
FIG. 3 is a view of the interior of the crankcase cover.
Figure 4:
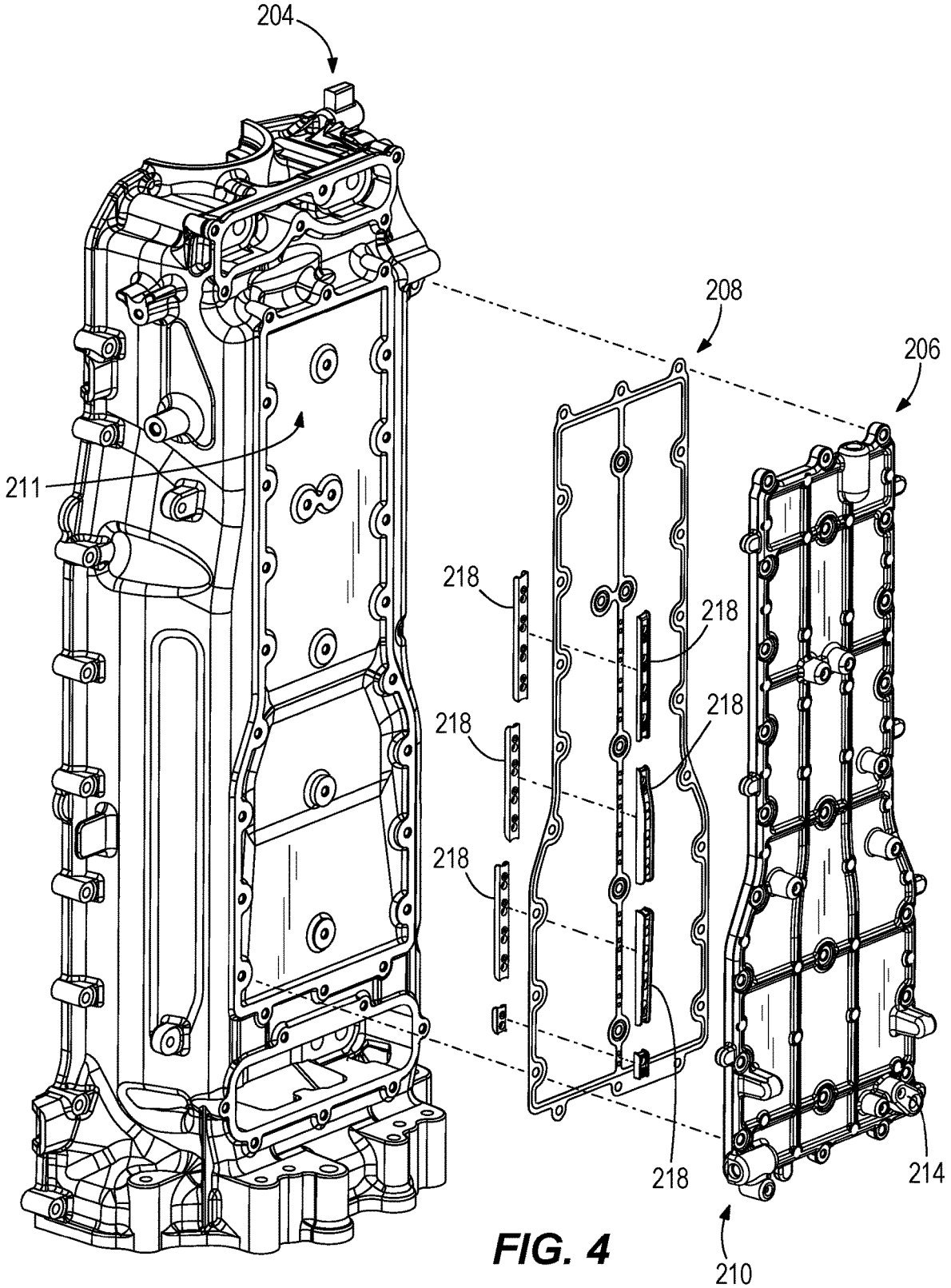
FIG. 4 is an exploded view of the crankcase cooler.
Figure 5:
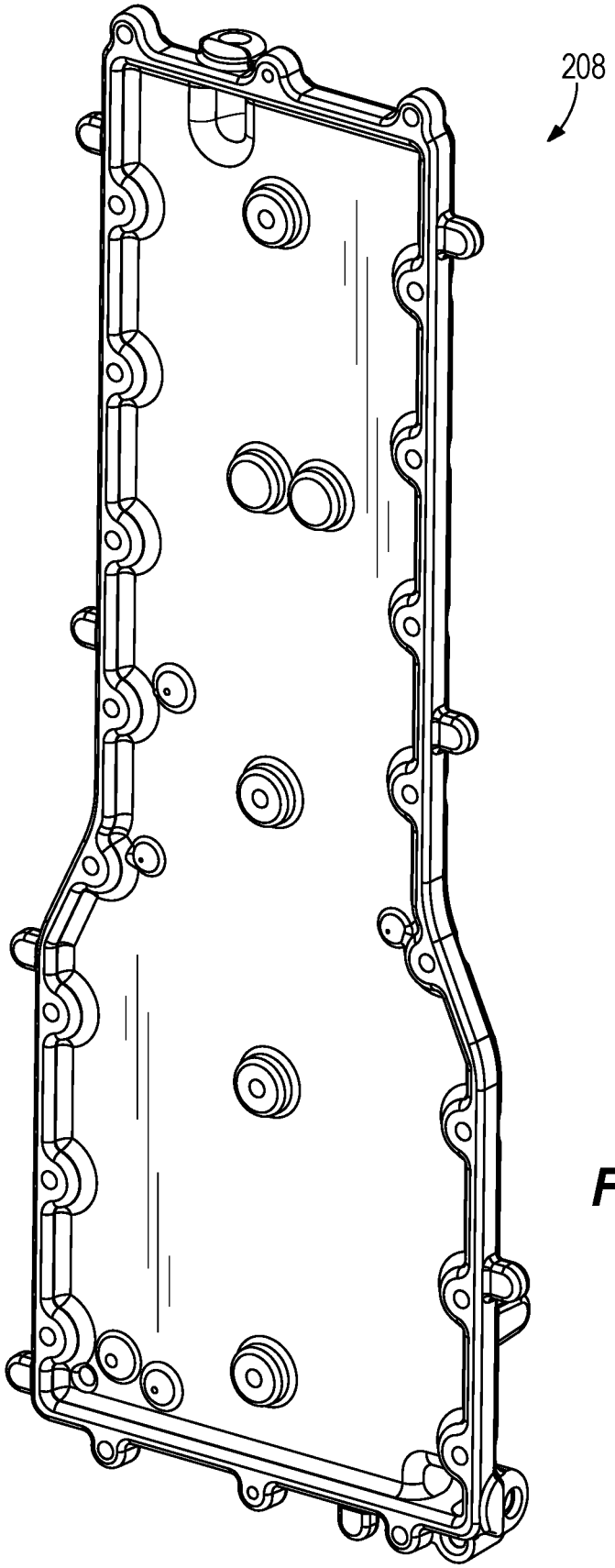
FIG. 5 is a perspective view of a cooler plate of the crankcase cooler.
Figure 6:
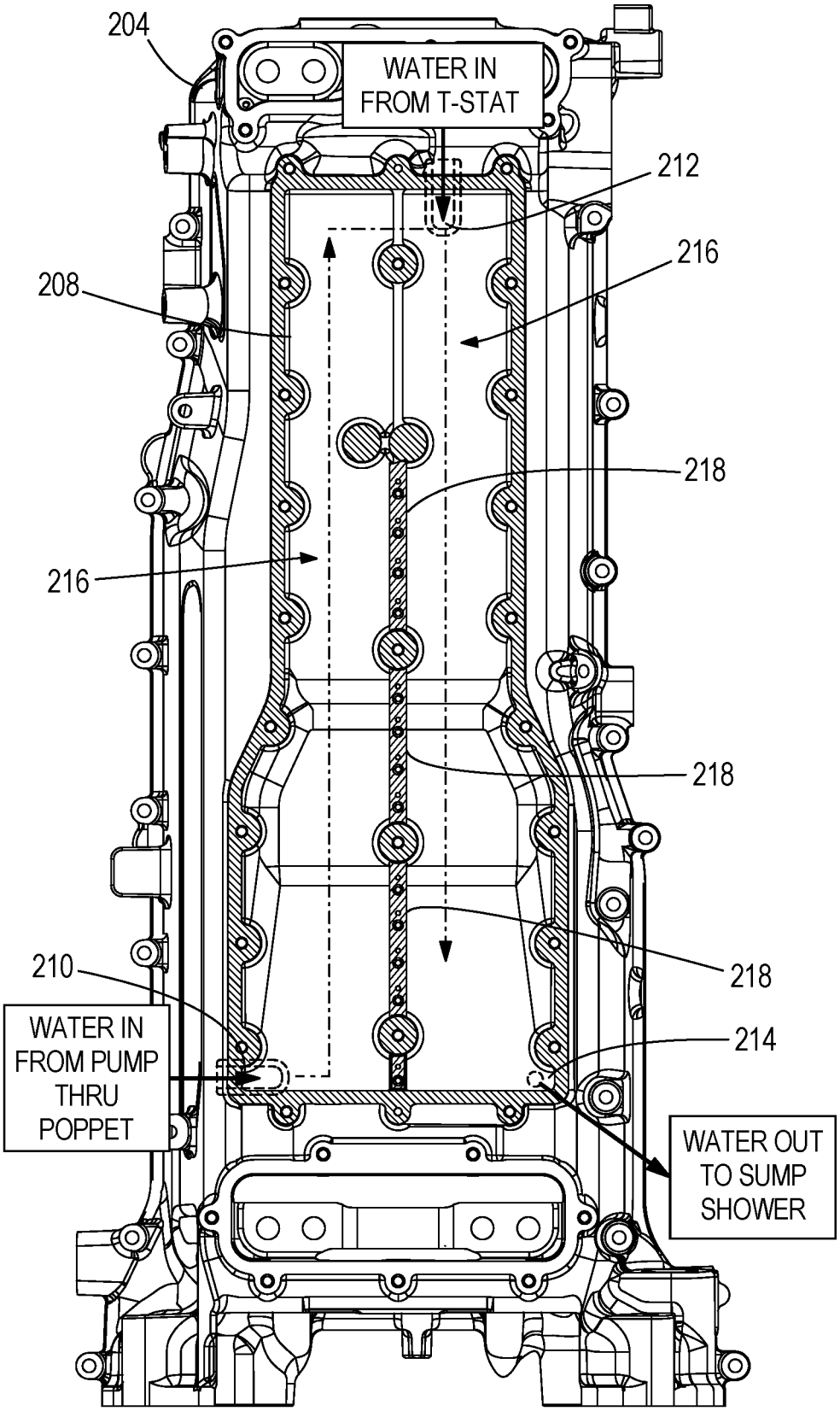
FIG. 6 is an exterior view of the crankcase cover and cooler plate, with the crankcase cooler cover removed, with annotations illustrating inlets and outlets for cooling water.

FIGS. 2-6 depict a non-limiting example of a crankcase 200 and crankcase cooler 202 for use in the cooling system 22 of the present disclosure. The crankcase cooler 202 is mounted on the crankcase 200 by fasteners (not shown) and includes portions of a crankcase cover 204 and a crankcase cooler cover 206 on the crankcase cover 204. FIG. 2 is a perspective view showing the crankcase 200 in dashed lines, the crankcase cover 204 in solid lines, and the crankcase cooler cover 206 on the crankcase cover 204. FIG. 3 is a view of the interior of the crankcase cover 204. FIG. 4 is an exploded view of the crankcase cooler 202. FIG. 5 is a perspective view of a cooler plate 208 of the crankcase cooler 202. FIG. 6 is an exterior view of the crankcase cover 204 and cooler plate 208, with the crankcase cooler cover 206 removed, with annotations illustrating inlets and outlets for cooling water.

Referring to FIG. 4, the exterior surface of the crankcase cooler cover 206 includes a recess 211 for conveying cooling water along the length of the crankcase cooler cover 206, for cooling the crankcase cooler cover 206, the crankcase 200 and the lubricant contained in the crankcase 200. Referring to FIG. 3, the interior surface of the crankcase cooler cover 206 has fins 205 that provide increased surface area for heat exchange between the cooling water in the crankcase cooler 202 and the lubricant in the crankcase 200.

Referring to FIG. 6, and commensurate with the explanation herein above regarding the embodiment of FIG. 1, the crankcase cooler 202 has a first inlet 210 that receives the second flow of cooling water from the bypass conduit 102. The crankcase cooler 202 has a second inlet 212 that receives the first flow of cooling water from the bypass conduit 112. The crankcase cooler 202 has an outlet 214 that drains the cooling water to the lubricant sump cooler 77 via the discharge conduit 118.

Referring to FIGS. 4 and 6, the crankcase cooler 202 is defined between the exterior surface of the crankcase cooler cover 206 and the interior surface of the crankcase cooler cover 206. Cooler plate 208 is disposed between the crankcase cooler cover 206 and the crankcase cooler cover 206 and guides the first and second flows of cooling water through a cooler conduit 216 that extends in a first direction (e.g., upwardly) along the length of the crankcase 200 and then through a U-turn back in the opposite, second direction (e.g., downwardly) along the length of the crankcase 200. Middle divider brackets 218 separate the flow into the first and second directions. In the illustrated example, the first inlet 210 is formed through the bottom of the crankcase cooler cover 206 and the second inlet 212 is formed through the top of the crankcase cooler cover 206. The outlet 214 is formed through the bottom of the crankcase cooler cover 206. As such, the second inlet 212 is located between the first inlet 210 and the outlet 214 relative to the flow of cooling water through the cooler conduit 216.

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus <10% of the particular term and "substantially" and "significantly" will mean plus or minus >10% of the particular term.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

The invention claimed is:

1. A marine drive for propelling a vessel in body of water, the marine drive comprising:

a powerhead, a crankcase on the powerhead, a cooling system that pumps a first flow of cooling water from the body of water through a powerhead cooling conduit for cooling the powerhead and in parallel pumps a second flow of cooling water from the body of water through a crankcase cooler for cooling the crankcase and lubricant in the crankcase, and a valve that controls the second flow of the cooling water to the crankcase cooler, wherein the valve is normally positioned in a closed position which inhibits the second flow of cooling water to the crankcase cooler and thereby reduces condensation of water from the lubricant in the crankcase, and wherein the valve is moved into an open position upon operation of the powerhead at or above a threshold speed, which permits the second flow of cooling water to the crankcase cooler and thereby cools the lubricant in the crankcase.

2. The marine drive according to claim 1, further comprising a pump device that pumps the first and second flows of cooling water to through the cooling system.

3. The marine drive according to claim 2, wherein the valve comprises a poppet that is retained in the closed position by a spring force, and wherein said operation of the powerhead at or above the threshold speed causes the second flow of cooling water to have a pressure that overcomes the spring force and opens the poppet.

4. The marine drive according to claim 2, wherein the pump device pumps the second flow of cooling water through the crankcase cooler via a first inlet in the crankcase cooler and via an outlet from the crankcase cooler.

5. The marine drive according to claim 4, wherein the outlet comprises a drain that gravity drains cooling water from the crankcase cooler.

6. The marine drive according to claim 4, further comprising a bypass conduit that connects the powerhead cooling conduit to the crankcase cooler to supply the first flow of cooling water cooling water to the crankcase cooler from the powerhead.

7. The marine drive according to claim 6, wherein the first flow of cooling water from the powerhead conduit is discharged to the crankcase cooler via a second inlet located between the first inlet and the outlet and then exits the crankcase cooler via the outlet.

8. The marine drive according to claim 7, wherein the first and second flows of cooling water are supplied to the crankcase cooler via the second and first inlets when the valve is in the open position.

9. The marine drive according to claim 8, wherein the outlet discharges the cooling water to a sump cooler for cooling a sump containing lubricant for the powerhead and crankcase.

10. The marine drive according to claim 9, wherein the sump cooler comprises a shower that showers the cooling water onto the sump.

11. The marine drive according to claim 4, wherein the outlet discharges the cooling water to a sump cooler for cooling a sump containing lubricant for the powerhead and crankcase.

12. The marine drive according to claim 11, wherein the sump cooler comprises a shower that showers the cooling water onto the sump.

13. A method of cooling a marine drive, the marine drive having a powerhead for propelling a vessel in body of water and a crankcase on the powerhead, the method comprising:

pumping a first flow of cooling water from the body of water through a powerhead cooling conduit for cooling the powerhead and, in parallel, pumping a second flow of cooling water through a crankcase cooler for cooling the crankcase and lubricant in the crankcase, and permitting the second flow of cooling water to the crankcase cooler only when the powerhead is operated at or above a threshold speed to thereby reduce condensation of water from lubricant when the powerhead is operated below the threshold speed.

14. The method according to claim 13, further comprising discharging the first flow of cooling water from the powerhead cooling conduit to the crankcase cooler.

15. The method according to claim 14, further comprising pumping the second flow of cooling into the crankcase cooler via a first inlet and draining the crankcase cooler via an outlet.

16. The method according to claim 15, further comprising discharging the first flow of cooling water to the crankcase cooler via a second inlet located between the first inlet and the outlet.

17. The method according to claim 16, further comprising discharging the first and second flows of cooling water from the crankcase cooler to a sump cooler for cooling a sump containing the lubricant.

18. A marine drive for propelling a vessel in body of water, the marine drive comprising:

a powerhead, a crankcase on the powerhead, a pump device that pumps a first flow of cooling water from the body of water through a powerhead cooling conduit for cooling the powerhead and in parallel pumps a second flow of cooling water from the body of water through a crankcase cooler for cooling the crankcase and lubricant in the crankcase, and a valve that controls the second flow of the cooling water to the crankcase cooler, wherein the valve is normally positioned in a closed position which inhibits the second flow of cooling water to the crankcase cooler, thereby preventing condensation of water from the lubricant in the crankcase, and wherein operation of the powerhead at or above a threshold speed causes the valve to move into an open position which permits the second flow of cooling water to the crankcase cooler, thereby cooling the lubricant in the crankcase.

19. The marine drive according to claim 18, wherein the valve comprises a poppet that is retained in the closed position by a spring force, and wherein said operation of the powerhead at or above the threshold speed causes the second flow of cooling water to have a pressure that overcomes the spring force and opens the poppet.

20. The marine drive according to claim 19, further comprising a bypass conduit that connects the powerhead cooling conduit to the crankcase cooler to supply the first flow of cooling water cooling water to the crankcase cooler from the powerhead.

* * * * *